United States Patent [19]

Ecklund

[11] Patent Number: 4,489,431

[45] Date of Patent: Dec. 18, 1984

[54] SIGNAL INTERFERENCE PROTECTION CIRCUIT FOR AM STEREO RECEIVER

[75] Inventor: Lawrence M. Ecklund, Wheaton, Ill.

[73] Assignee: Motorola, Inc.

[21] Appl. No.: 386,374

[22] Filed: Jun. 8, 1982

[51] Int. Cl.[3] ..... H04H 5/00

[52] U.S. Cl. ..... 381/15; 455/307

[58] Field of Search ..... 381/11, 12, 15; 455/46, 455/47, 202, 302–308, 309, 312

[56] References Cited

U.S. PATENT DOCUMENTS

| | | | |
|---|---|---|---|
| 4,169,968 | 10/1979 | Parker | 381/15 |
| 4,192,970 | 3/1980 | Kahn | 455/307 X |
| 4,368,356 | 1/1983 | Ecklund et al. | 381/15 |
| 4,379,208 | 4/1983 | Isbell et al. | 381/15 |

*Primary Examiner*—R. J. Hickey

*Attorney, Agent, or Firm*—Margaret Marsh Parker; James W. Gillman

[57] ABSTRACT

In the field of AM stereo detection, co-channel or adjacent channel interference may cause some distortion and side-to-side movement of a stereo signal source as well as false "stereo detect" signals in AM stereo receivers having phase locked loop (PLL) systems. The invention provides a filter receiving the incoming signal and passing only the frequencies resulting from said interference; a sensor measures the output of the filters and if this signal is above a given level, the monophonic mode is enabled, i.e., the pilot detector, the stereo presence indicator and the stereo mode switch are disenabled for a timed interval. A higher given level of interference is required for stereo disenablement when stereo transmission with pilot tone is already being received.

5 Claims, 7 Drawing Figures

SIGNAL INTERFERENCE PROTECTION CIRCUIT FOR AM STEREO RECEIVER

BACKGROUND OF THE INVENTION

This invention relates to the field of AM Stereo tone detection and, more particularly, to the prevention of false or unsatisfactory operation of a stereo tone detector and other stereo receiver circuits due to reception of an intefering signal.

Co-channel interference; i.e., interference caused by another transmitter at almost the same frequency as the one being listened to, is well known in the field of broadcasting. Such interference can be a problem for monophonic receivers in that the two audio signals would be heard simultaneously. In an AM stereo receiver, it can cause additional problems. In some stereo receivers, a phase locked loop (PLL) is used to derive a cosine correction signal from the phase modulated carrier (RF or IF). In other receivers, the PLL may also be used in the demodulation process to provide the stereophonic audio output signals, usually termed L and R for the left and right signals of a stereo program. In the case of the cosine correction signal, co-channel interference may cause a very slight amount of distortion, but the effect on the demodulation of L and R can be an apparent side-to-side movement of a signal source. If the signal which indicates the presence of stereophonic transmission is an infrasonic tone; e.g. 5–25 Hz, co-channel interference may cause false "stereo detect" signals when, in fact, no stereo signal is being received. These detect signals could not only indicate the presence of stereo as by a "stereo" light but can enable the stereo mode of operation, an undesirable effect. If stereophonic signals with the stereo tone added are being received when co-channel interference occurs, the receiver would remain in stereo but the apparent motion of the signal source would be perceived. If co-channel interference is significant, therefore, it would be desirable to disenable the stereo mode of operation. In some broadcast situations, adjacent channel interference may also be a problem, also making the monophonic mode more desirable.

SUMMARY OF THE INVENTION

It is an object, therefore, of the present invention to prevent co-channel or adjacent channel interference from having a serious effect on AM stereo broadcast reception.

It is a particular object to prevent any indication of the presence of stereophonic signals when none are being received.

It is another particular object to prevent interference from affecting the perceived spacing or position of the signal sources.

It is still another object to prevent such interference from enabling the stereo mode in a receiver when only monophonic transmissions are being received.

These objects, and others which will become apparent, are achieved by a circuit in accordance with the invention wherein the incoming signal (RF or IF) or some portion of that signal is filtered to pass only the infrasonic frequencies which would result from co-channel interference. The filter output is then examined and, if there is a signal present at a given level, the monophonic mode of operation is enabled; i.e., the stereo presence tone detector, the correction circuit and the stereo mode switch will be disenabled for a brief, timed interval. If a stereophonic transmission with added tone is being received, a higher level of filter output signal is required to disenable the tone detector. If adjacent channel interference is a problem, a high pass filter would be used and its output would also control the mode of operation.

DETAILED DESCRIPTION OF A PREFERRED EMBODIMENT

Figure 1:
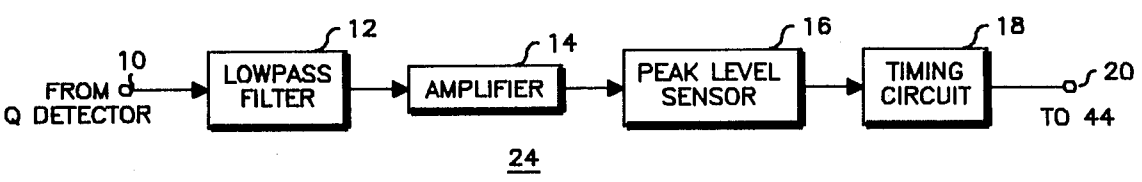
FIG. 1 is a block diagram of the circuit of a portion of the present invention.
Figure 2:
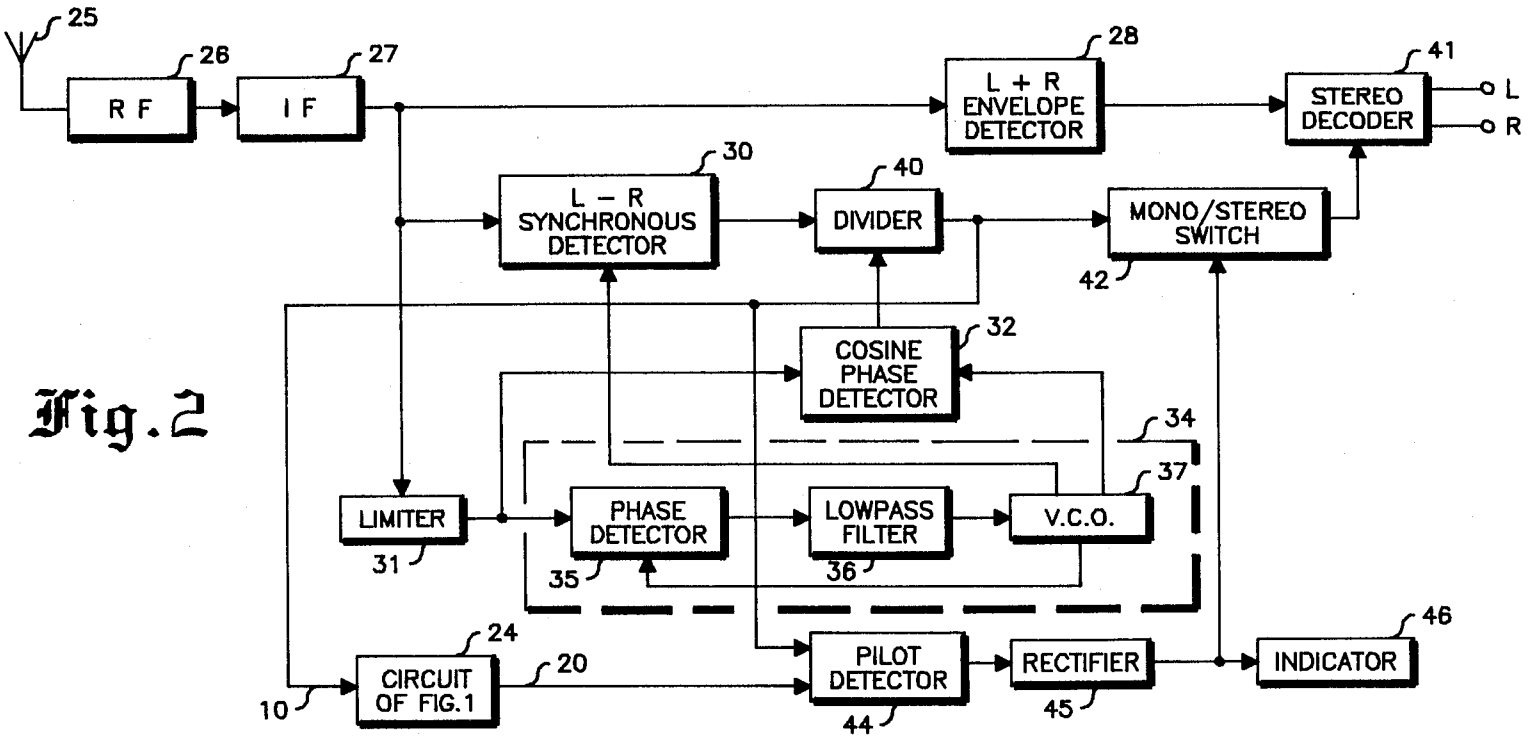
FIG. 2 is a block diagram of a stereophonic receiver including the present invention.

FIG. 1 is a simplified block diagram of the present invention and shows an input terminal 10 providing an input signal coming from the L-R channel of a stereo receiver (see FIG. 2). The two channels of an AM stereophonic system are usually termed I (for In-phase) or envelope modulation) and Q (for quadrature or phase modulation) with I generally representing the monophonic or 1+L+R modulation and Q representing some function of the difference signal L−R.

The Q signal is filtered in a low pass filter 12. The filter output, which is very small even in the presence of interference, is coupled to an amplifier 14. Following the amplifier is a peak level sensor 16 which provides an output signal when a predetermined level of filter output is detected. The predetermined level may vary with different received signal characteristics as will be explained with respect to FIG. 4. The output signal of the level sensor activates a timing circuit 18. The timing circuit may be a circuit within the stereo tone detector circuit of a stereo receiver or the timer may be a portion of the corrector circuit. As will be explained with respect to FIG. 3 the correction circuit 24 may merely couple a signal to the tone detector which restarts or resets the detector to a "slow mode". Since in the slow mode of operation, the detector cannot provide a stereo tone detect signal for a given period, this arrangement is the equivalent of a discrete timer following the level detect circuit.

FIG. 2 is a block diagram of an AM stereophonic receiver taken from U.S. Pat. No. 4,159,398 with the addition of a block 24 representing the circuit of FIG. 1. This receiver is only one of many which could utilize the present invention, and neither the receiver nor the signal with which that receiver was designed to operate should be construed as limiting on the present invention.

The receiver of FIG. 2 is designed to receive a signal of the form $(1+L+R)\cos(\omega_c t+\phi)$ where $\omega_c t$ is a carrier frequency and $\phi$ is arc tan $[(L-R+ST)/(1+L+R)]$ where ST is a stereo indication tone or "pilot" tone as it is commonly called in FM stereo broadcasting. This signal is received at a receiver antenna 25 and processed in the customary manner in an RF stage 26 and an IF stage 27 to provide an intermediate frequency signal. The sum or monophonic signal is recovered from the IF signal in an envelope detector 28. The IF stage output is also coupled to a synchronous detector 30 and a limiter 31. In the limiter 31, amplitude variations are removed and the limiter output carries only the stereo phase modulation which is proportional to cos $(\omega_c t+\phi)$. The output of the limiter 31 is coupled to a cosine phase detector 32 which is a multiplier. The output of the limiter 31 is also coupled to a phase lock loop 34, the latter including a phase detector 35, low pass filter 36 and a VCO 37. An output of the VCO 37, which is a function of sin $\omega_c t$ is coupled to the synchronous detector 30 (also a multiplier wherein multiplication of the VCO 37 output and the received signal (with IF carrier) provides a signal $(1+L+R)\cos(\omega_c t+\phi)\sin\omega_c t$ which, disregarding the double frequency term, is $(1+L+R)\sin\arctan[(L-R)/(1+L+R)]$ or $(1+L+R)\sin\phi$ which, it will be seen is $(L-R)\cos\phi$. A phase shifted output cos $\omega_c t$ of the VCO 37 is also coupled to the cosine phase detector 32 in which the two outputs are combined to provide a signal proportional to cosine $\phi$. When this latter signal and the output of the synchronous detector 30 are processed in a divider 40, the resultant signal is the original difference signal (plus the small 25 Hz stereo presence signal). The differnce signal is coupled to a stereo decoder or matrix 41 through a mono/stereo mode switch 42, the function of which will be described hereinafter. The signal from the divider 40 is also coupled through a pilot tone detector 44 which will amplify and detect the 25 Hz tone which was added to the L-R channel to indicate the presence of a stereophonic signal. The pilot detector output, rectified in a rectifier 45, is coupled to control the mode switch 42 and also to a stereo indicator 46 which may be a simple LED or other indicator device. Thus, during stereo transmission, the detection of the 25 Hz pilot tone will not only enable a stereo indicator, but will switch the circuit into the stereo mode via the mono/stereo mode switch 42. The mode switch could be a voltage controlled switch which, when appropriate control signals are applied, opens or closes a circuit.

The circuit 24 of the present invention may be coupled to the output of the L-R detector 30, or to an AGC'd L-R signal in this particular application of the invention. In other embodiments, the envelope signal or $1+L+R$ signal could be used to activate the protector circuit.

Figure 3:
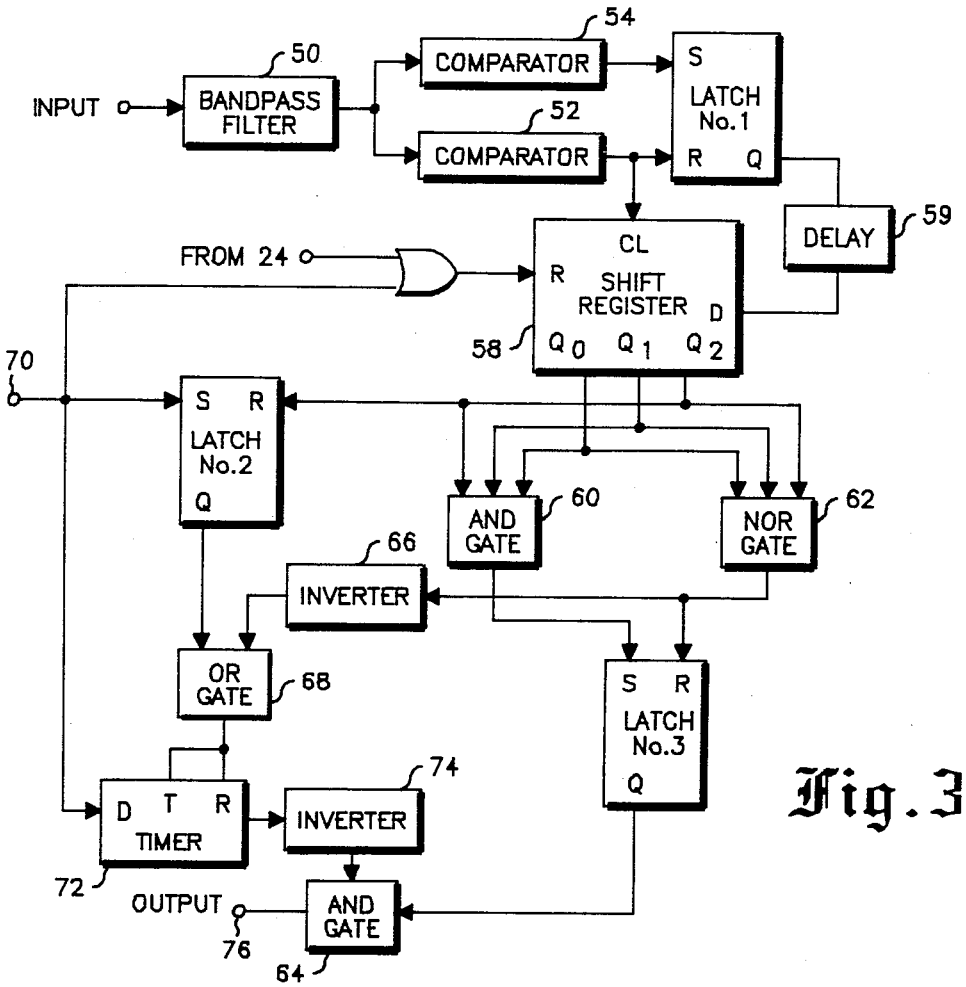
FIG. 3 is block diagram of a stereo presence tone detector which cooperates with the protector circuit of FIG. 1.

The tone detector circuit shown in block diagram form in FIG. 3 is taken essentially from a co-pending application assigned to the assignee of the present invention which is U.S. Pat. No. 4,410,762. The input signal of the filter 50 is essentially $L-R+ST$, as described above. The filter 50 is a band pass filter centered on the frequency of the stereo (ST) presence or "pilot" tone; e.g. 25 Hz. The output of the filter 50 is coupled separately to two comparators 52, 54. The output of the comparator 52 is coupled to the "reset" input of a latch L1 and to the "clear" input of a shift register 58. The output of comparator 54 is coupled to the "set" input of the latch L1. The latch L1 output is also coupled to the data input of the register 58, this interconnection including a delay 59 if needed. The register outputs are coupled in parallel to two logic gates, an AND gate 60 and a NOR gate 62. For purposes of simplification, only three output terminals Q0, Q1, Q2 of the register 58 are shown, but it will be apparent that any desired number of outputs can be utilized. The Q2 output of the register 58 is coupled to the "reset" input of a latch L2. The AND gate 60 output is coupled to the "set" input of a latch L3 and the NOR gate 62 output is coupled to the "reset" input of the latch L3. The latch L3 output is coupled to an AND gate 64. The NOR gate 62 output is also coupled through an inverter circuit 66 to one input of an OR gate 68 whose other input is the output of the latch L2. Latches L1–L3 may be implemented by three of the sections of a quad NOR R-S latch such as the Motorola 14043B. The shift register 58 may be implemented by a dual four-bit static shift register such as the Motorola MC14015. The "reset" of the shift register 58 and the "set" of the latch L2 can be coupled via an input terminal 70 to an external circuit (not shown) such as an "out-of-lock" detector, for shutting down the tone detector circuit during tuning. The output of the OR gate 68 is coupled to the "trigger" and "reset" inputs of a timing circuit 72 such as the Motorola MC1555. A typical time delay would be 750 msec. The timer output is coupled through an inverting circuit 74 to a second input of the AND gate 64, the output of the gate 64 being available at a terminal 76.

The signals being inputted to the filter 50 may be comprised of many frequencies, but the filter output signal will be essentially a sine wave, depending on the design of the filter circuit. The maximum amplitude will, of course, vary and may possibly go to zero for short periods. The comparators 52, 54 have different threshold levels. The threshold for the comparator 52 may be at or near zero so that the comparator functions essentially as a zero crossing detector. Since there will normally be sufficient extraneous signal at or near the tone frequency to trigger the comparator 52, the output of the comparator will be a fairly regular square wave at the tone frequency. In addition to serving as the reset signal for the latch L1, the comparator 52 output signal serves as the clock input signal for the shift register 58. The threshold for the comparator 54 will preferably be set at some point near but lower than the expected peak amplitude of the tone signal, and the output pulses of the comparator 54 will be narrower than the output pulses of the comparator 52. The latch L1 then is set by the leading edge of the comparator 54 output and reset by the leading edge of the comparator 52 output. The latch L1 output is coupled to the "data" input of the shift register 58. At the first detection of the signal of the proper frequency and amplitude, a one would be coupled from the latch L1 to the shift register and, when clocked in, a "one" would appear at the Q0 output of the register for a parallel output of 0-0-1. At the second and third consecutive detects, the register outputs would be 0-1-1 and 1-1-1 respectively. At the third detect, all inputs to the AND gate 60 are one's, thus a one is coupled to the set input of the latch L3 and the latch input becomes a one. If, after latch L3 has been latched, one cycle of the tone signal is missing or of too low a value, the register 58 outputs would become 1-1-0, but the latch L3 will stay latched. If, however, three pulses are missing or are too low, the shift register outputs will become 0-0-0. Since the shift register outputs are also the NOR gate 62 inputs, the NOR gate will now output a one, resetting the latch L3 and causing the latch output to go to zero. The latch output will then stay at zero until three consecutive cycles have been detected in the filter 50 output signal. The out-of-lock signal from the terminal 70 is also coupled to the "set" input of latch L2 and the Q2 output of the register 58 is coupled to the "reset" input. When a one appears at Q2, the latch L2 output will go low and stay low. If a series of 0's then appears in the latch one output signal, filing the register 58 so that the NOR 62 output goes high, the signal out of the inverter 66 on the second input of the OR gate 68 will put a falling wave form on the trigger/reset of the timer 72. This falling wave form starts the timing period and puts a zero on one input of the AND 64. The output at the terminal 76 is then also a zero or "no pilot tone" signal.

If, during the timing period, another one is shifted though the register 58, followed by a series of zero's the timer 72 will be reset for a second timing period by another falling wave form from the OR gate 68. Even if the shift register 58 is subsequently filled with one's, setting the latch L3 high, no detect signal will be produced at the terminal 36 until the second timing period is over. Thus, during the period of very noisy signals, the pilot detector is prevented from falsing.

With the addition of the protector circuit 24 to the tone detector circuit of FIG. 3 of the prior art, an OR gate 78 will be inserted in the reset input of the shift register 58. A second input to the OR gate 78 will come from the circuit 24, thus an output from the circuit 24, indicating that significant co-channel interference is present, will reset the shift register 58 and the output at the terminal 76 will be "no stereo present".

It is reiterated here that the tone detector circuit of FIG. 3 is merely one of the possible tone detector circuits which will utilize the protector circuit of the present invention, and no limitation thereto should be inferred.

Figure 4A:
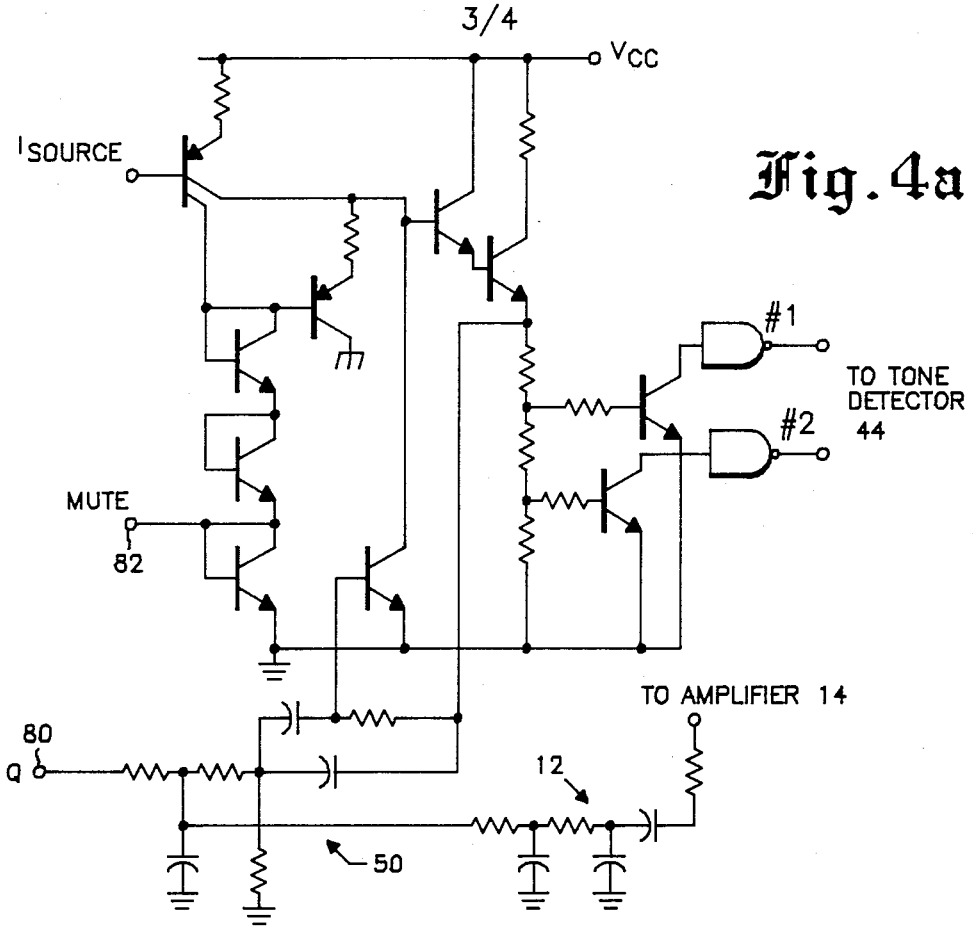
FIG. 4A, 4B and 4C constitute a schematic/logic diagram of the block diagram of FIG. 3.

The FIGS. 4A, B and C are schematic/logic diagrams of portions of the circuit of an AM stereo receiver including the present invention. FIG. 4A includes the bandpass filter 50 of the tone detector 44 and the filter 12 of the protector circuit 24. The signal at an input terminal 80 may be the Q or difference signal $(L-R)\cos\phi$, $(L-R+\text{stereo tone})\cos\phi$ or some other function of Q. The signal at the "mute" terminal 82, will preferably be the signal which, in an all-electronic radio, mutes the audio when tuning between stations. The Q signal will be filtered in the bandpass filter 50 to provide an output relating to the pilot tone or stereo presence tone for use in the pilot tone detector 44. In the preferred embodiment, there are two such outputs, #1 and #2 which provide signals in response to tone detects at two different amplitude levels. The circuit providing output #1 to the tone detector amounts to a zero crossing detector and the circuit providing output #2 is a high level tone detect. These functions are further described in the co-pending application as referenced herein above. The filter section designated reference number 12 is coupled to the amplifier 14, the signal at the terminal 84 is amplified in the co-channel amplifier 14 and coupled, preferably at two levels, to the inputs #1 and #2 of the tone detector coming from the amplifier.

Figure 5:
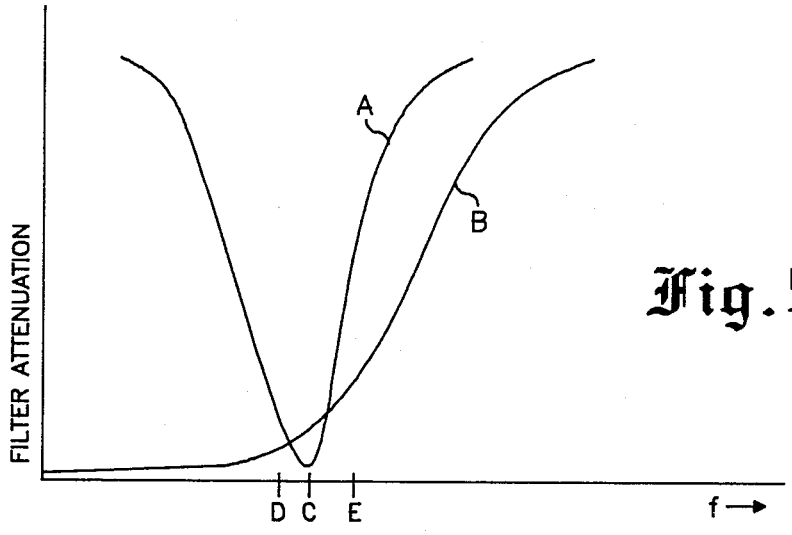
FIG. 5 is a chart of attenuation relating to the detector of FIG. 3.

Referring here to the diagram of FIG. 5, the complementary functioning of the two filter sections 50 and 12 may be seen to provide a high level of protection for the receiver circuitry. In this diagram, curve A represents the attenuation of the bandpass filter 50. curve B represents the characteristic of the low pass filter 12. The bandpass filter is centered at the frequency of the desired tone signal, preferably 25 Hz, represented by the point C. The characteristics of both curve A and curve B help prevent false detect signals, but may be seen that with only the pilot tone filter 50 in the circuit, a very strong signal at a frequency significantly higher or lower than the 25 Hz tone could still cause a false detect. By adding the low pass filter, no signal lower in frequency than point D or higher in frequency than point E can cause a false detect. In the window between point D and E, an interference beat could cause a false detect if the pilot tone detector 44 did not require that any detected tone, real or false, must be sustained for a significant interval of time; e.g., two seconds before a "stereo detect" signal is outputted. It is, therefore, nearly impossible for a false detect signal to occur.

Figure 4B:
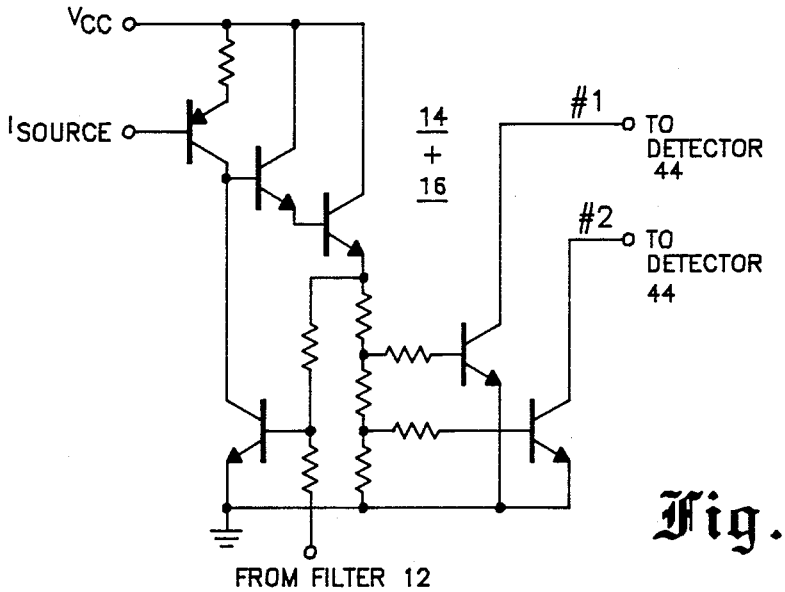
Figure 4C:
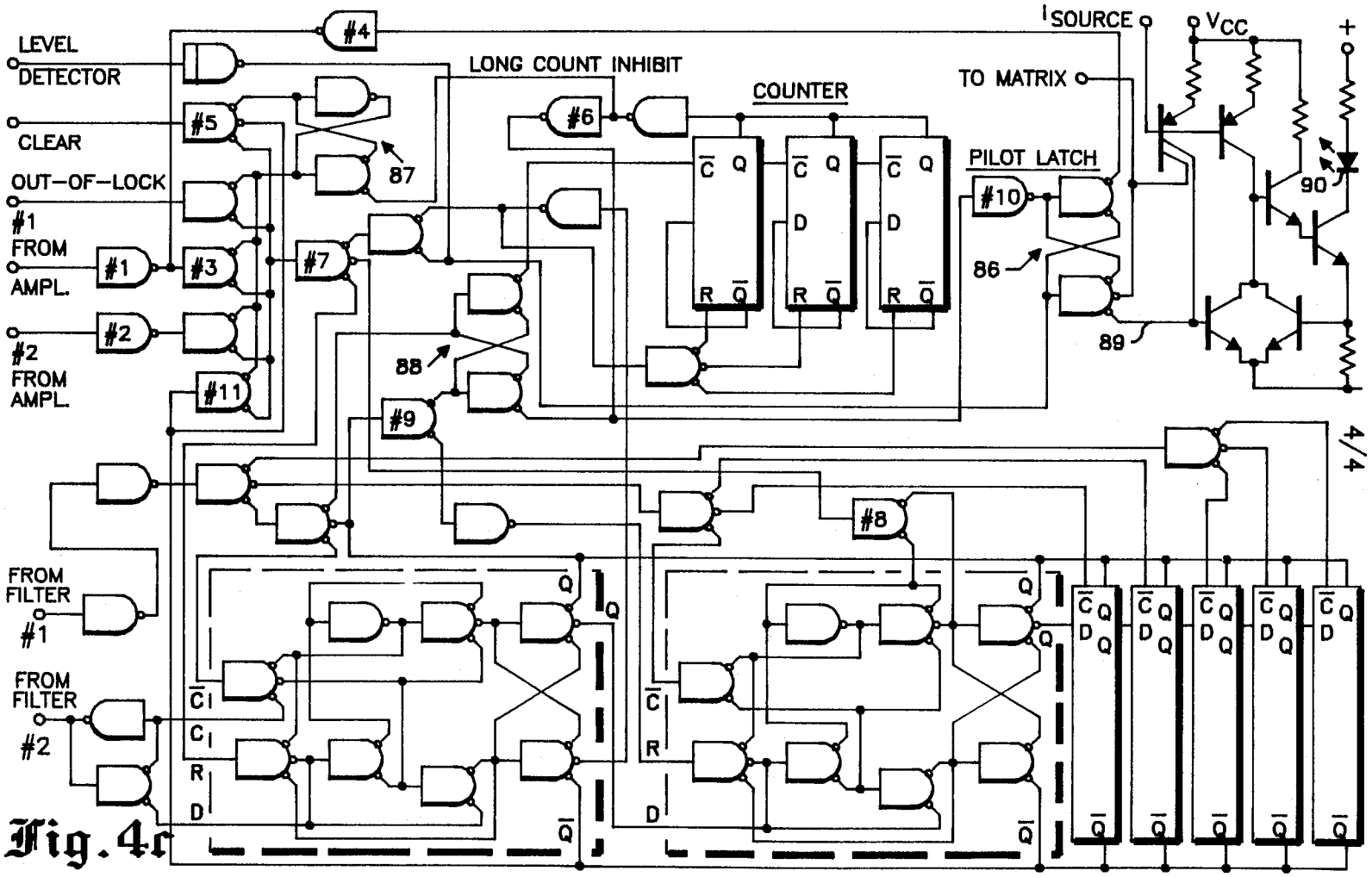

FIG. 4C then shows a preferred embodiment of most of the tone detector shown in block form in FIG. 3. It will be apparent to those skilled in the art that FIGS. 4A, 4B and 4C are an $I^2L$ implementation of the tone detector, whereas the block diagram of FIG. 3 was based on a CMOS implementation. The two are, however, broadly equivalent. One input to the tone detector of FIG. 4C is a level detect signal coming from a "level detector" circuit (not shown) and is a measure of the amplitude of the Q signal. The "clear" signal is derived from the mute signal which was discussed hereinabove. The "out-of-lock" signal is the signal at terminal 70 in FIG. 3 and is a measure of the tuning of the desired channel. Signals "#1 from amplifier" and "#2 from amplifier" come from the co-channel amplifier 14 as shown in FIG. 4B. Gate #1 is usually operative and constitutes the lower trip level and gate #2 the higher trip level. Gate #1 is coupled to gate #3, which in turn may also be turned off by a signal through gate #4 which would be activated from the pilot latch 86 when there is a tone detect, thus defeating the lower threshold gate combination. If gate #5 goes high due to a low input on the "clear" input, the latch 87 goes low and forces the tone detector to operate in the short count mode. The signal labeled "long count inhibit" is coupled to gate #6 and the pilot latch 86 will be reset if the second input from latch 88 is also a one. An output of the latch 86 is coupled back to the matrix or stereo decoder 41 of FIG. 2. It will be seen that the input to the latch 88 is a composite of all Q's from the shift register which in this embodiment will be seen to include seven segments. Each latch or flip-flop of the shift register goes high in response to a cycle of stereo tone signal of a satisfactory level. When the output of gate #7 goes high, this puts a one on the reset of the first section of the shift register and, through gate #8 puts a zero on the set input of the second section of the shift register. The shift register must then wait until the zero is clocked out of the register for a detect to occur in the short mode of operation. The one is added to prevent a series of all zeros in the shift register from initiating the long mode of operation.

If a pilot tone is present, a series of one's will be clocked through the shift register and when all Q's are high, the input to gate #9 will be high, the output will be low, the output of the flip-flop 88 will be high to gate #10 (coupled to the input of the latch 86). Under these circumstances, the output of the flip-flop 87 will be high and gate 10 will output a low to the latch 86. The pilot latch 86 is now reset, the output 89 of the latch will activate the control circuit for the LED 90 and the stereo indicator 46 will now be "on".

Thus, there has been shown and described a protection circuit for an AM stereo receiver comprising means for receiving a signal containing, in addition to the desired stereophonic audio information, a predetermined infrasonic tone for indicating the presence of stereophonic information, and which may also contain interfering signals such as co-channel or adjacent channel interference. In addition to providing control of various receiver functions by the presence and characteristics of the received infrasonic tone, the circuit also controls those functions in accordance with the amount of interfering signal being received. Thus, false stereo detect signals and stereo indications are prevented, the stereophonic mode will not be enabled when suitable signals are not being received and, possibly, the distortion correcting circuit will not be enabled under those conditions. Other variations and modifications of the present invention are possible and it is intended to cover all such that fall within the spirit and scope of the appended claims.

What is claimed is:

1. A protection circuit for an AM stereo receiver having input means for receiving a signal which may contain a predetermined infrasonic tone and which may also contain interfering signals; the protection circuit comprising:

filter means coupled to the input means and having a pass band for passing only the range of possible frequencies of said interfering signals;

level sensing means coupled to the filter means output for providing an output signal in response to filtered signals having at least a predetermined amplitude;

detector means coupled to the input means for detecting the presence of said predetermined infrasonic tone and controlling at least one portion of said receiver in response thereto;

first control means coupled to the detector means input for resetting the detector means; and timing control means coupled to the level sensing means output and to the detector means input for cooperating in the control of the at least one receiver portion.

2. A protection circuit for an AM stereo receiver in accordance with claim 1 and wherein the interfering signals are the result of an unwanted broadcasting station at essentially the same frequency as the desired station.

3. A protection circuit for an AM stereo receiver in accordance with claim 1 and wherein the interfering signals are the result of an unwanted broadcasting station on a broadcast channel adjacent to the channel of the desired station.

4. A protection circuit for an AM stereo receiver in accordance with claim 1 and wherein the at least one portion of the receiver is a stereo tone indicator.

5. A protection circuit for an AM stereo receiver in accordance with claim 1 and wherein the at least one portion of the receiver is a stereo/mono mode control circuit.

* * * * *

UNITED STATES PATENT AND TRADEMARK OFFICE

CERTIFICATE OF CORRECTION

PATENT NO. : 4,489,431

DATED : 12-18-84

INVENTOR(S) : Ecklund

It is certified that error appears in the above-identified patent and that said Letters Patent is hereby corrected as shown below:

On the title page

Under [19], after the name Ecklund, insert -- et al. --.

In the line preceeded by [75], delete "Inventor" and insert -- Inventors --.

In the line preceeded by [75], insert -- Roy H. Espe, Scottsdale, Az. --.

In column 2, line 27, delete ")".

In column 3, line 12, insert -- ) -- after the word multiplier.

In column 3, line 25, delete "differnce" and insert -- difference --.

In column 5, line 9, delete "though" and insert -- through --.

Signed and Sealed this

*Twenty-third* Day of *April 1985*

[SEAL]

*Attest:*

DONALD J. QUIGG

*Attesting Officer*

*Acting Commissioner of Patents and Trademarks*